US010873157B1

(12) United States Patent
Costello et al.

(10) Patent No.: US 10,873,157 B1
(45) Date of Patent: Dec. 22, 2020

(54) PULL TAB FOR A PLUG CONNECTOR

(71) Applicants: TE Connectivity Services GmbH, Schaffhausen (CH); Tyco Electronics (Shanghai) Co., Ltd., Shanghai (CN)

(72) Inventors: Brian Patrick Costello, Scotts Valley, CA (US); Setha Yim, Sunnyvale, CA (US); Qianjin Li, Shanghai (CN)

(73) Assignees: TE CONNECTIVITY SERVICES GmbH, Schaffhausen (CH); TYCO ELECTRONICS (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/733,499

(22) Filed: Jan. 3, 2020

(51) Int. Cl.
*H01R 13/627* (2006.01)
*H01R 13/633* (2006.01)

(52) U.S. Cl.
CPC ..... *H01R 13/6335* (2013.01); *H01R 13/6272* (2013.01)

(58) Field of Classification Search
CPC ..... H01R 13/6272; H01R 13/6335
USPC ..... 439/352
See application file for complete search history.

(56) References Cited

U.S. PATENT DOCUMENTS 5,564,939 A * 10/1996 Maitani ..... H01R 13/6335 439/352
6,439,918 B1 * 8/2002 Togami ..... G02B 6/4246 439/157
6,733,323 B2 5/2004 Tso-Chin
6,773,305 B2 8/2004 Wu
7,040,911 B1 * 5/2006 Ho ..... G02B 6/4292 439/352
7,112,076 B2 9/2006 Wu
7,281,937 B2 * 10/2007 Reed ..... H01R 13/6275 439/352
7,318,740 B1 * 1/2008 Henry ..... H01R 13/6275 439/352
7,322,845 B2 * 1/2008 Regnier ..... H01R 13/6275 439/352
7,473,124 B1 * 1/2009 Briant ..... H01R 13/6275 439/352
7,549,886 B2 * 6/2009 Herring ..... H01R 13/6275 439/352
7,666,023 B2 * 2/2010 Wu ..... H01R 13/6275 439/352
8,231,400 B2 * 7/2012 Phillips ..... G02B 6/4284 439/357
8,500,470 B2 * 8/2013 Wang ..... G02B 6/4261 439/159

(Continued)

*Primary Examiner* — Neil Abrams

(57) ABSTRACT

A plug connector includes a housing holding plug connector contacts and a latch assembly. The latch assembly includes a latch with a latch beam movable between a latched position and an unlatched position and an actuator for moving the latch. The latch assembly includes a pull tab extending from the rear of the housing having first and second attachment members. The first attachment member is coupled to the actuator proximate to a first end of the housing and is movable in a rearward pulling direction to move the actuator and actuate the latch to the unlatched position. The first attachment member pulls the first end of the housing to unmate the housing from the mating connector. The second attachment member is coupled to a second end of the housing to pull the second end of the housing and unmate the housing from the mating connector.

20 Claims, 6 Drawing Sheets

(56) References Cited

U.S. PATENT DOCUMENTS

| | | | | |
|---|---|---|---|---|
| 8,506,319 | B2 * | 8/2013 | Ritter | H01R 13/6335 439/352 |
| 8,562,373 | B2 * | 10/2013 | Wu | H01R 13/6658 439/352 |
| 8,585,426 | B2 * | 11/2013 | Zerebilov | H01R 13/6335 439/370 |
| 8,787,025 | B2 * | 7/2014 | Wu | H01R 13/6335 361/740 |
| 9,028,270 | B1 * | 5/2015 | Vanderwoud | H01R 13/6335 439/476.1 |
| 9,246,262 | B2 * | 1/2016 | Brown | H01R 13/62 |
| 9,250,402 | B2 | 2/2016 | Ishii et al. | |
| 9,496,645 | B2 * | 11/2016 | Reed | H01R 13/6275 |
| 9,564,711 | B2 * | 2/2017 | Tanaka | H01R 13/6272 |
| 9,601,868 | B2 * | 3/2017 | Barrefelt | H01R 13/6275 |
| 9,671,582 | B2 * | 6/2017 | Yeh | H04B 10/40 |
| 9,728,871 | B1 * | 8/2017 | Gutgold | H01R 13/6275 |
| 10,020,614 | B1 * | 7/2018 | Bucher | H01R 13/6275 |
| 10,193,277 | B2 * | 1/2019 | Leigh | H01R 13/6335 |
| 10,665,989 | B2 * | 5/2020 | Suda | H01R 13/6272 |
| 10,732,364 | B2 * | 8/2020 | Scherer | H04Q 1/136 |

* cited by examiner

PULL TAB FOR A PLUG CONNECTOR

CROSS-REFERENCE TO RELATED APPLICATIONS

This application claims benefit to Chinese Application No. 201911163578.8, which was filed Nov. 22, 2019 and is titled PULL TAB FOR A PLUG CONNECTOR. The subject matter of which is herein incorporated by reference in its entirety.

BACKGROUND OF THE INVENTION

The subject matter herein relates generally to plug connectors.

Connector systems including mating connectors configured to be mated for data and/or power transmission through the connector system. For example, the connector systems typically include complementary plug connectors and receptacle connectors configured to be mated to and unmated from each other. The connectors typically include latching features to secure mating of the plug connector with the receptacle connector. For example, the plug connector may include a deflectable latch having a latch beam configured to be received in a latch opening of the receptacle connector.

However, known connectors are not without disadvantages. For instance, some known connectors use pull tabs to release the latch. However, the pulling force of the pull tab is transferred to the latch, which is at one side of the connector, such as at the top of the connector. As the pull tab is pulled rearward, the plug connector is rotated or pivoted relative to the receptacle connector, which may cause binding of the plug connector on the receptacle connector, increasing the pulling force needed to unmate the plug connector from the receptacle connector. The increased pulling force may damage the pull tab or the latch.

A need remains for a cost effective and reliable latching system for a plug connector.

BRIEF DESCRIPTION OF THE INVENTION

In one embodiment, a plug connector is provided including a housing having a front, a rear, a first end, a second end, a first side, and a second side. The housing has a mating end at the front for mating with a mating connector and a latch pocket at the first end. The plug connector includes plug connector contacts held by the housing provided proximate to the mating end for mating with the mating connector. The plug connector includes a latch assembly coupled to the housing for latchably securing the plug connector to the mating connector. The latch assembly includes a latch received in the latch pocket having a main body and a latch beam extending from the main body. The latch beam is movable between a latched position and an unlatched position. The latch beam is configured to be received in a latch opening of the mating connector to secure the plug connector to the mating connector in the latched position and is removable from the latch opening in the unlatched position. The latch assembly includes an actuator operably coupled to the latch to move the latch to a released position. The actuator engages the main body of the latch for actuation of the latch. The latch assembly includes a pull tab extending from the rear of the housing. The pull tab has a first attachment member coupled to the actuator proximate to the first end of the housing that is movable in a rearward pulling direction to move the actuator so that the latch is moved to the unlatched position. The first attachment member pulls the first end of the housing to unmate the housing from the mating connector with the latch in the unlatched position. The pull tab has a second attachment member coupled to the second end of the housing. The second attachment member pulls the second end of the housing to unmate the housing from the mating connector with the latch in the unlatched position.

In an embodiment, a plug connector is provided including a housing having a front, a rear, a first end, a second end, a first side, and a second side. The housing has a mating end at the front for mating with a mating connector and a latch pocket at the first end. The housing has contact channels extending between the front and the rear arranged in an upper row proximate to the first end and a lower row proximate to the second end. The plug connector includes plug connector contacts held by the housing and received in corresponding contact channels. The plug connector contacts are arranged in the upper row and the lower row. The plug connector contacts are provided proximate to the mating end for mating with the mating connector and are terminated to ends of cables that extend from the rear. The plug connector includes a latch assembly coupled to the housing for latchably securing the plug connector to the mating connector. The latch assembly includes a latch received in the latch pocket having a main body and a latch beam extending from the main body. The latch beam is movable between a latched position and an unlatched position. The latch beam is configured to be received in a latch opening of the mating connector to secure the plug connector to the mating connector in the latched position and is removable from the latch opening in the unlatched position. The latch assembly includes an actuator operably coupled to the latch to move the latch to a released position. The actuator engages the main body of the latch for actuation of the latch. The latch assembly includes a pull tab extending from the rear of the housing. The pull tab has an upper attachment member coupled to the actuator proximate to the first end of the housing movable in a rearward pulling direction to move the actuator so that the latch is moved to the unlatched position. The upper attachment member pulls the first end of the housing above the upper row to unmate the housing from the mating connector with the latch in the unlatched position. The pull tab has a lower attachment member coupled to the second end of the housing. The lower attachment member pulls the second end of the housing below the lower row to unmate the housing from the mating connector with the latch in the unlatched position.

In an embodiment, a plug connector is provided including a housing having a front, a rear, a first end, a second end, a first side, and a second side. The housing has a mating end at the front for mating with a mating connector and a latch pocket at the first end. The housing has contact channels extending between the front and the rear arranged in an upper row proximate to the first end and a lower row proximate to the second end. The plug connector includes plug connector contacts held by the housing and received in corresponding contact channels. The plug connector contacts are arranged in the upper row and the lower row. The plug connector contacts are provided proximate to the mating end for mating with the mating connector and are terminated to ends of cables that extend from the rear. The plug connector includes a latch assembly coupled to the housing for latchably securing the plug connector to the mating connector. The latch assembly includes a latch received in the latch pocket having a main body and a latch beam extending from the main body. The latch beam is movable between a latched position and an unlatched position. The latch beam is configured to be received in a latch opening of the mating connector to secure the plug connector to the mating connector in the latched position and is removable from the latch opening in the unlatched position. The latch assembly includes an actuator operably coupled to the latch to move the latch to a released position. The actuator engages the main body of the latch for actuation of the latch. The latch assembly includes a pull tab extending from the rear of the housing. The pull tab has an upper attachment member coupled to the actuator proximate to the first end of the housing and a lower attachment member coupled to the second end of the housing. The pull tab has a side rail extending between the upper attachment member and the lower attachment member. The side rail extends along a side of the cables. The side rail is pulled to pull the upper attachment member in a rearward pulling direction to move the actuator and actuate the latch to the unlatched position. The upper attachment member and the lower attachment member pull the housing rearward to unmate the housing from the mating connector with the latch in the unlatched position.

DETAILED DESCRIPTION OF THE INVENTION

Figure 1:
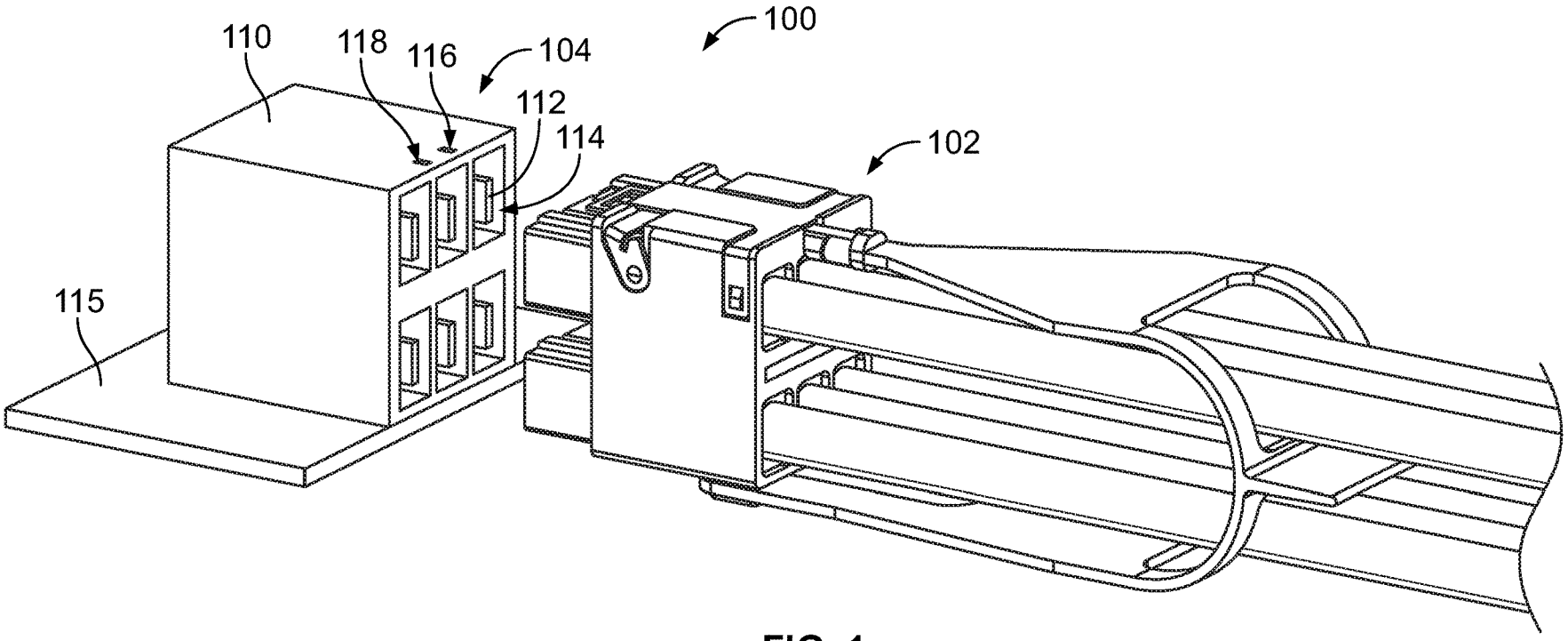
FIG. 1 illustrates a connector system formed in accordance with an exemplary embodiment.

FIG. 1 illustrates a connector system 100 formed in accordance with an exemplary embodiment. The connector system 100 includes a plug connector 102 and a receptacle connector 104. The plug connector 102 is configured to be mated with the receptacle connector 104 at a separable mating interface. The receptacle connector 104 defines a mating connector for the plug connector 102.

The receptacle connector 104 includes a housing 110 holding receptacle connector contacts 112 configured to be mated with the plug connector 102. The receptacle connector contacts 112 may be arranged within a cavity 114 that receives a portion of the plug connector 102. The housing 110 and the receptacle connector contacts 112 may be terminated to a circuit board 115. For example, the receptacle connector contacts 112 may be press-fit in vias in the circuit board 115 or soldered to the circuit board 115, such as in plated through-holes. In other various embodiments, the receptacle connector 104 may be a cable connector terminated to an end of a cable with the receptacle connector contacts 112 terminated to wires of the cable. Mating ends of the receptacle connector contacts 112 may be pin contacts or socket contacts. In alternative embodiments, the receptacle connector 104 may have a card slot (not shown) at a front of the housing 110 configured to receive a circuit card of the plug connector 102 and the mating ends of the receptacle connector contacts 112 may be spring beam contacts configured to be mated with the circuit card. In other various embodiments, the housing 110 of the receptacle connector 104 may hold a circuit card configured to be mated with the plug connector 102 with the receptacle connector contacts 112 being contact pads on the circuit card.

The receptacle connector 104 includes latching features 116 for latchably securing the plug connector 102 to the receptacle connector 104. In the illustrated embodiment, the latching features 116 include latch openings 118 in the housing 110 configured to receive complementary latching features of the plug connector 102. The latch openings 118 are defined by walls surrounding the latch openings 118. In the illustrated embodiment, the latch openings 118 are provided in the housing 110, such as in the top wall of the housing 110. For example, the top wall of the housing 110 may be a metal sheet or plate with the latch opening 118 stamped or cut into the top wall. The latch openings 118 may be provided at other locations in alternative embodiments. In an exemplary embodiment, a portion of the plug connector 102 is loaded into the housing 110 to interface with the latching features 116 from inside the housing 110.

Figure 2:
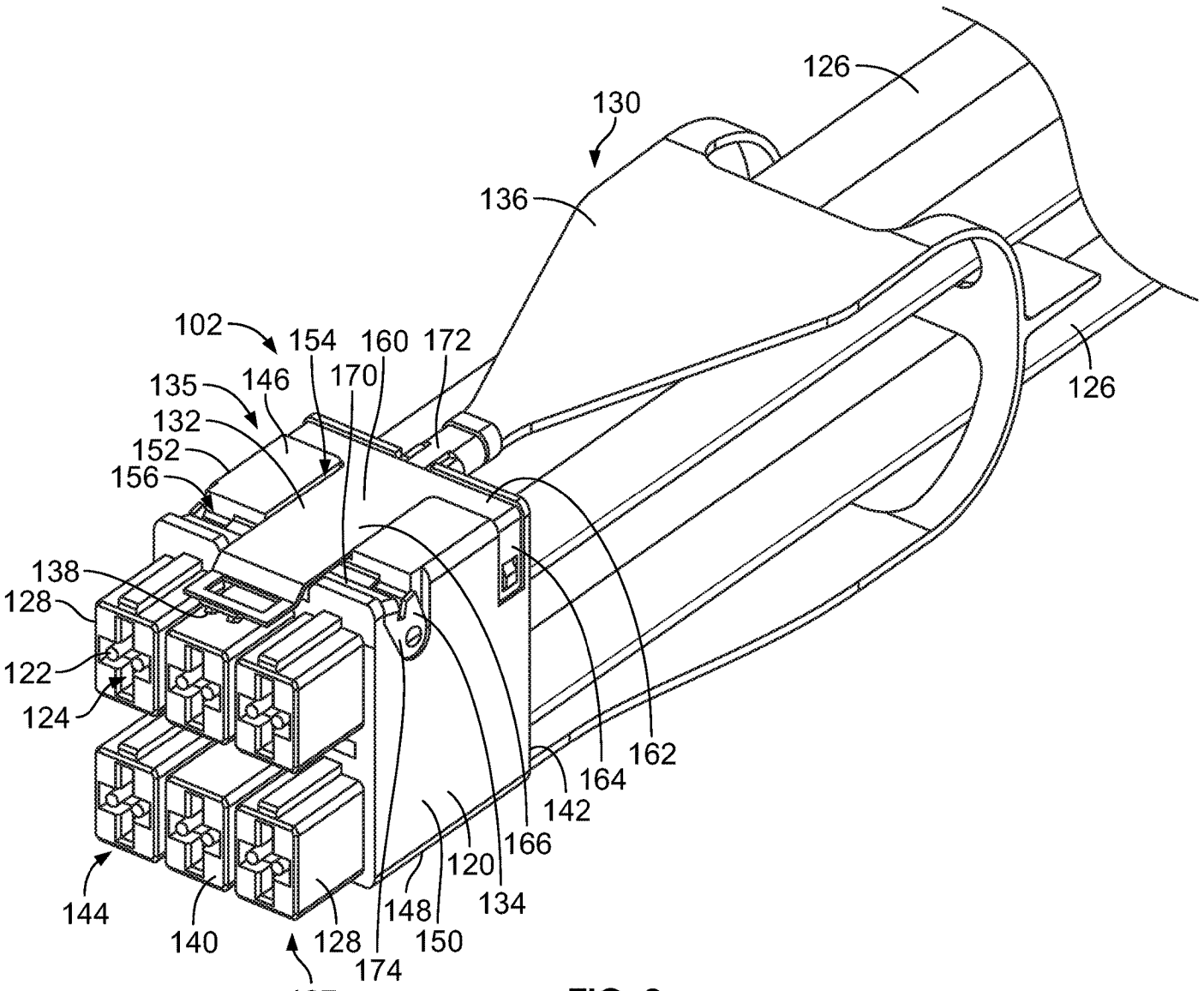
FIG. 2 is a front perspective view of a plug connector of the connector system in accordance with an exemplary embodiment.

FIG. 2 is a front perspective view of the plug connector 102 in accordance with an exemplary embodiment. The plug connector 102 includes a housing 120 holding plug connector contacts 122 configured to be mated with corresponding receptacle connector contacts 112 of the receptacle connector 104 (both shown in FIG. 1). In an exemplary embodiment, the housing 120 includes contact channels 124 that receive the plug connector contacts 122. The contact channels 124 may extend into shrouds 128 at the front of the housing 120. The shrouds 128 may be arranged in rows, such as an upper row and a lower row. The plug connector contacts 122 may similarly be arranged in an upper row and a lower row.

The plug connector contacts 122 may be pin contacts, socket contacts, spring beam contacts, such as dual-spring beam contacts, blade contacts, or other types of contacts. The plug connector contacts 122 may be stamped and formed contacts in various embodiments. In other various embodiments, the housing 120 may hold a circuit card, such as a paddle card, having contact pads defining the plug connector contacts 122. In other various embodiments, the housing 120 of the plug connector 102 may include a card slot configured to receive a circuit card of the receptacle connector 104.

In an exemplary embodiment, the plug connector 102 includes cables 126 extending from the rear of the housing 120. The cables 126 may be arranged in an upper row and a lower row. The cables 126 are electrically connected to corresponding plug connector contacts 122. For example, the plug connector contacts 122 may be crimped to ends of the cables 126.

The plug connector 102 includes a latch assembly 130 for latchably securing the plug connector 102 to the receptacle connector 104. The latch assembly 130 includes a latch 132, an actuator 134 for actuating the latch 132 between a latched position and an unlatched position, and a pull tab 136 for pulling on and moving the actuator 134. The latch 132 is coupled to the housing 120. In an exemplary embodiment, the latch 132 includes latch beams 138 configured to be received in the latch openings 118 (FIG. 1) of the receptacle connector 104 to secure the plug connector 102 to the receptacle connector 104.

The actuator 134 is operably coupled to the latch 132 for actuating the latch 132 to move the latch beams 138 between the latched positions and the unlatched positions, such as to release the plug connector 102 from the receptacle connector 104. The actuator 134 may be coupled to the housing 120. For example, the actuator 134 may be pivotably coupled to the housing 120 to rotate to a releasing position to release the latch beams 138 from the receptacle connector 104. In various embodiments, the actuator 134 is pivoted or rocked rearward to lift the latch 132 upward and release the latch beams 138. Other actuating movements are possible in alternative embodiments.

The pull tab 136 causes movement (for example, pivoting) of the actuator 134, and thus actuation of the latch 132 by pulling rearward on the pull tab 136. In an exemplary embodiment, the pull tab 136 is connected to the actuator 134 at a top 135 of the plug connector 102. Pulling rearward on the pull tab 136 pulls the top 135 of the plug connector 102 rearward to unmate the plug connector 102 from the receptacle connector 104. In an exemplary embodiment, the pull tab 136 is connected to the housing 120 at a bottom 137 of the plug connector 102. Pulling rearward on the pull tab 136 pulls the bottom 137 of the plug connector 102 rearward to unmate the plug connector 102 from the receptacle connector 104. The rearward pulling forces are distributed between the top 135 and the bottom 137 of the plug connector 102 by the attachment of the pull tab 136 at the top 135 and the bottom 137 of the plug connector 102. The pull tab 136 has loops at the rear of the pull tab 136 that provide finger grips for gripping the pull tab 136 and pulling the pull tab 136 rearward. For example, the finger grips may be located along both sides of the bundle of cables 126. The pull tab 136 may include a cross-member between the rear loops to strengthen the pull tab 136 and/or to provide a finger grip for gripping and pulling rearward on the pull tab 136. The cross-member may extend through the bundle of cables 126, such as between an upper row and a lower row of the cables 126.

The pull tab 136 causes actuation of the latch 132 by pulling on the actuator 134 to cause the latch 132, and thus the latch beams 138, to pivot and move outward to the released positions. Further pulling on the pull tab 136, after the latch 132 is in the released position, causes the plug connector 102 to be pulled rearward to remove the plug connector 102 from the receptacle connector 104. The pulling forces are distributed to the top and the bottom of the plug connector 102 and may be distributed to both sides to control the unmating direction (for example, to limit pivoting—vertically and/or horizontally—of the plug connector 102 relative to the receptacle connector 104) and ensure unmating in a rearward direction (e.g., perpendicular to the mating faces of the connectors 102, 104). In an exemplary embodiment, the latch 132 is rotated from the latched position to the released position when the pull tab 136 is pulled in the rearward pulling direction without loading the latch 132 against the receptacle connector 104. For example, the rearward pulling action of the pull tab 136 is initially transferred into rotating of the latch 132 before being transferred into rearward pulling of the housing 120. Such releasing of the latch 132 eliminates the risk of binding of the latch 132 against the receptacle connector 104, thus reducing the releasing force of the latch 132.

The housing 120 of the plug connector 102 includes a front 140 and a rear 142. The plug connector contacts 122 may be located proximate to the front 140 for mating with the receptacle connector 104. In an exemplary embodiment, the housing 120 has a mating end 144 at the front 140 for mating with the mating connector defined by the receptacle connector 104.

The housing 120 includes a first end 146 and a second end 148 opposite the first end 146. The first and second ends 146, 148 extend between the front 140 and the rear 142. In various orientations, the first end 146 may be a top end and the second end 148 may be a bottom end; however, other orientations are possible in alternative embodiments. The latch 132 is provided at the first end 146.

The housing 120 includes a first side 150 and a second side 152 opposite the first side 150. The first and second sides 150, 152 extend between the front 140 and the rear 142. The first and second sides 150, 152 extend between the first end 146 and the second end 148. In various embodiments, the housing 120 may be generally rectangular shaped; however, other shapes are possible in alternative embodiments.

In an exemplary embodiment, the housing 120 has a latch pocket 154 at the first end 146. The latch pocket 154 may extend to the rear 142. The latch 132 is received in the latch pocket 154. The housing 120 includes an actuator pocket 156 adjacent to the latch pocket 154. The actuator 134 is received in the actuator pocket 156. The actuator pocket 156 may be located at the first end 146, such as under the latch pocket 154. The actuator pocket 156 may extend to the rear 142 such that the actuator 134 extends from the rear 142 of the housing 120.

The latch 132 is received in the latch pocket 154. The latch 132 includes a main body 160. In an exemplary embodiment, the latch 132 is a stamped and formed component with the main body 160 and the latch beams 138 being integral with each other and being stamped and formed from a common sheet of metal. Alternatively, the main body 160 may be separately formed from the latch beams 138 and coupled thereto, such as being welded or fastened to the latch beams 138. The main body 160 includes a base 162 at a rear of the latch 132 configured to be mounted to the housing 120. For example, the base 162 includes mounting tabs 164, such as along the first and second sides 150, 152 of the housing 120. The main body 160 includes an arm 166 extending forward from the base 162. The actuator 134 is operably coupled to the arm 166. The latch beams 138 extend from the arm 166. The arm 166 may be moved relative to the base 162. For example, the arm 166 may be lifted upward to unlatch the latch beams 138.

The actuator 134 is received in the actuator pocket 156. The actuator 134 includes an actuating beam 170 operably coupled to the latch 132 and a connecting beam 172 extending from the actuating beam 170. The connecting beam 172 is operably coupled to the pull tab 136. For example, the connecting beam 172 may be crimped to the pull tab 136. As the pull tab 136 is pulled rearward, the pull tab 136 pulls the connecting beam 172 rearward. The rearward movement of the connecting beam 172 is transferred to the actuating beam 170. In an exemplary embodiment, the actuator 134 is a stamped and formed component with the actuating beam 170 and the connecting beam 172 being integral with each other and being stamped and formed from a common sheet of metal. Alternatively, the actuating beam 170 may be separately formed from the connecting beam 172 and coupled thereto, such as being welded or fastened to the connecting beam 172. In an exemplary embodiment, the actuating beam 170 includes mounting tabs 174 coupled to the first and second sides 150, 152 of the housing 120. The mounting tabs 174 may be pivotably coupled to the housing 120, such as at axles extending from the sides 150, 152.

Figure 3:
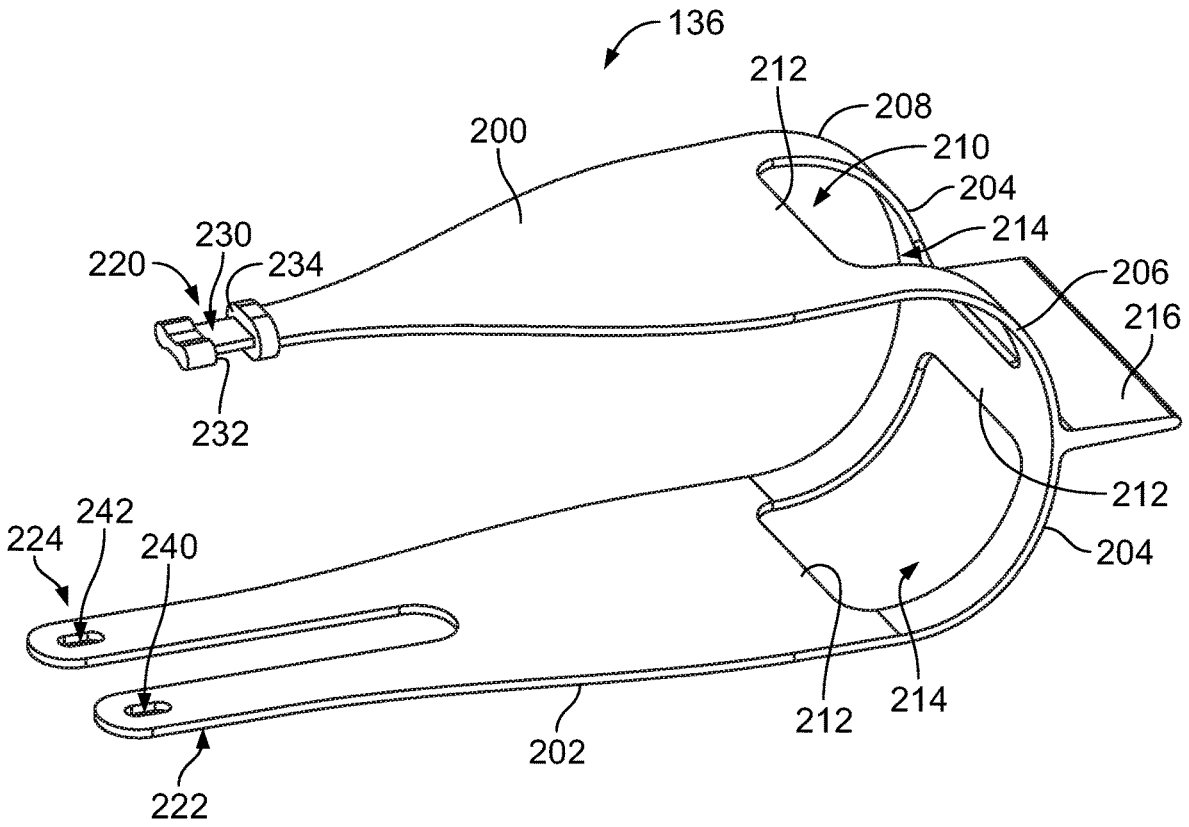
FIG. 3 is a top perspective view of a pull tab of the plug connector in accordance with an exemplary embodiment.

FIG. 3 is a top perspective view of the pull tab 136 in accordance with an exemplary embodiment. The pull tab 136 includes an upper member 200 and a lower member 202. The pull tab 136 includes one or more rear loops 204 at a rear 205 between the upper member 200 and the lower member 202. The rear loops 204 may provide a finger ring or finger grip for pulling the pull tab 136 rearward. The cables 126 (shown in FIG. 2) are configured to pass through the pull tab 136 between the upper member 200 and the lower member 202.

The pull tab 136 includes a first side rail 206 at a first side of the pull tab 136 and a second side rail 208 at a second side of the pull tab 136. The side rails 206, 208 are separated by a gap 210. In an exemplary embodiment, the pull tab 136 includes tie beams 212 between the side rails 206, 208. The tie beams 212 may be located at the upper member 200 and/or the lower member 202. The tie beams 212 are cross-members used to hold relative positions of the first and second side rails 206, 208. The tie beams 212 strengthen the pull tab 136.

In an exemplary embodiment, the pull tab 136 includes a window 214 between the side rails 206, 208. The cables 126 may exit the pull tab 136 through the window 214. The window 214 is located at the rear of the pull tab 136, such as at the rear loops 204. In an exemplary embodiment, one of the tie beams 212 may span across the window 214 between the side rails 206, 208 at the rear loops 204.

The pull tab 136 may include a strengthening member 216 between the side rails 206, 208, such as between the rear loops 204 at the rear 205 of the pull tab 136. The strengthening member 216 may extend along the tie beam 212, such as rearward of the tie beam 212, to strengthen the tie beam 212. The strengthening member 216 may provide an anti-crush feature for the pull tab 136 and/or the cables 126. The strengthening member 216 may provide a finger grip for pulling the pull tab 136 rearward. In various embodiments, the strengthening member 216 may include an opening therethrough, such as being ring shaped, to provide a finger ring for pulling rearward.

The pull tab 136 includes an upper attachment member 220, a first lower attachment member 222 and a second lower attachment member 224 providing three attachment points (for example, a triangulated attachment arrangement). The attachment members 220, 222, 224 define connection points between the pull tab 136 and the actuator 134 and the housing 120 (both shown in FIG. 2). The upper attachment member 220 is configured to be coupled to the actuator 134 to pull the actuator 134 rearward. The upper attachment member 220 is a movable attachment member 220 and is configured to be movable relative to the housing 120. The lower attachment members 222, 224 are configured to be coupled to the bottom of the housing 120. The lower attachment members 222, 224 are fixed attachment members configured to be fixed relative to the housing 120. The upper attachment member 220 is configured to pull the housing 120 in an unmating direction to unmate the housing 120 from the receptacle connector 104 (shown in FIG. 1). The lower attachment members 222, 224 are configured to pull the housing 120 in an unmating direction to unmate the housing 120 from the receptacle connector 104.

In an exemplary embodiment, the upper attachment member 220 includes a groove 230 configured to receive the connecting beam 172 of the actuator 134. The side rails 206, 208, along the upper member 200, may converge at the upper attachment member 220 at the front. The upper attachment member 220 includes a forward shoulder 232 forward of the groove 230 and a rearward shoulder 234 rearward of the groove 230. The forward shoulder 232 is used as a stop for the actuator 134 to pull rearward on the actuator 134. The upper attachment member 220 may have other shapes or features in alternative embodiments.

In an exemplary embodiment, the first lower attachment member 222 is provided along the first side rail 206 and the second lower attachment member 224 is provided along the second side rail 208. The first lower attachment member 222 includes an opening 240 configured to receive an attachment member, such as a tab or cleat extending from the bottom of the housing 120. The second lower attachment member 224 includes an opening 242 configured to receive an attachment member, such as a tab or cleat extending from the bottom of the housing 120. The first lower attachment member 222 is spaced apart from the second lower attachment member 224 to connect to the bottom of the housing 120 at spaced apart locations, such as at opposite sides of the housing 120. The lower attachment members 222, 224 may have other shapes or features in alternative embodiments. For example, the lower attachment members 222, 224 may be secured by a heat stake, a fastener, a clip, and the like.

Figure 4:
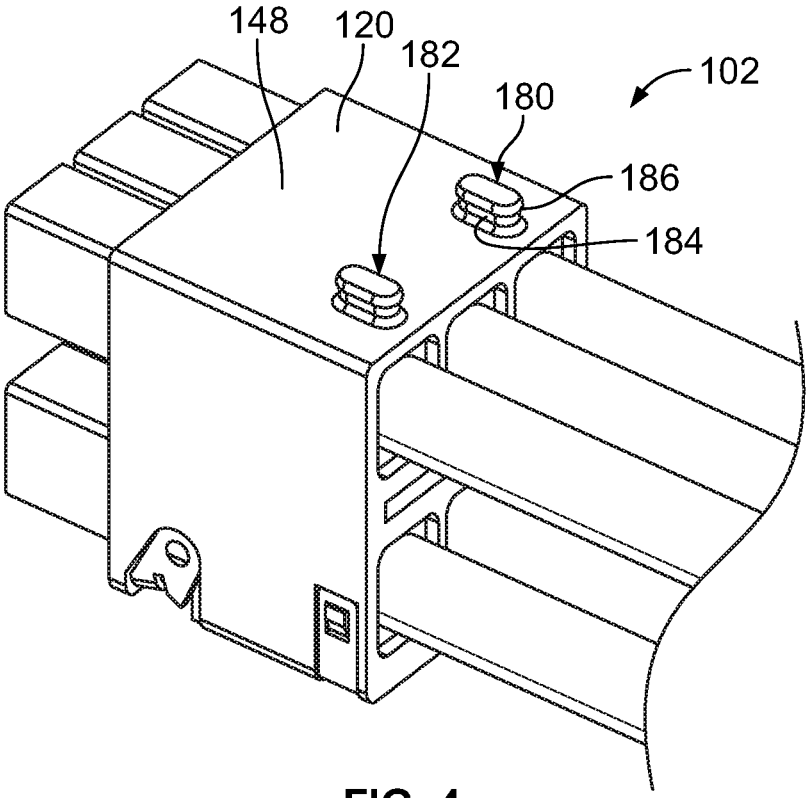
FIG. 4 is a bottom perspective view of the plug connector in accordance with an exemplary embodiment.
Figure 5:
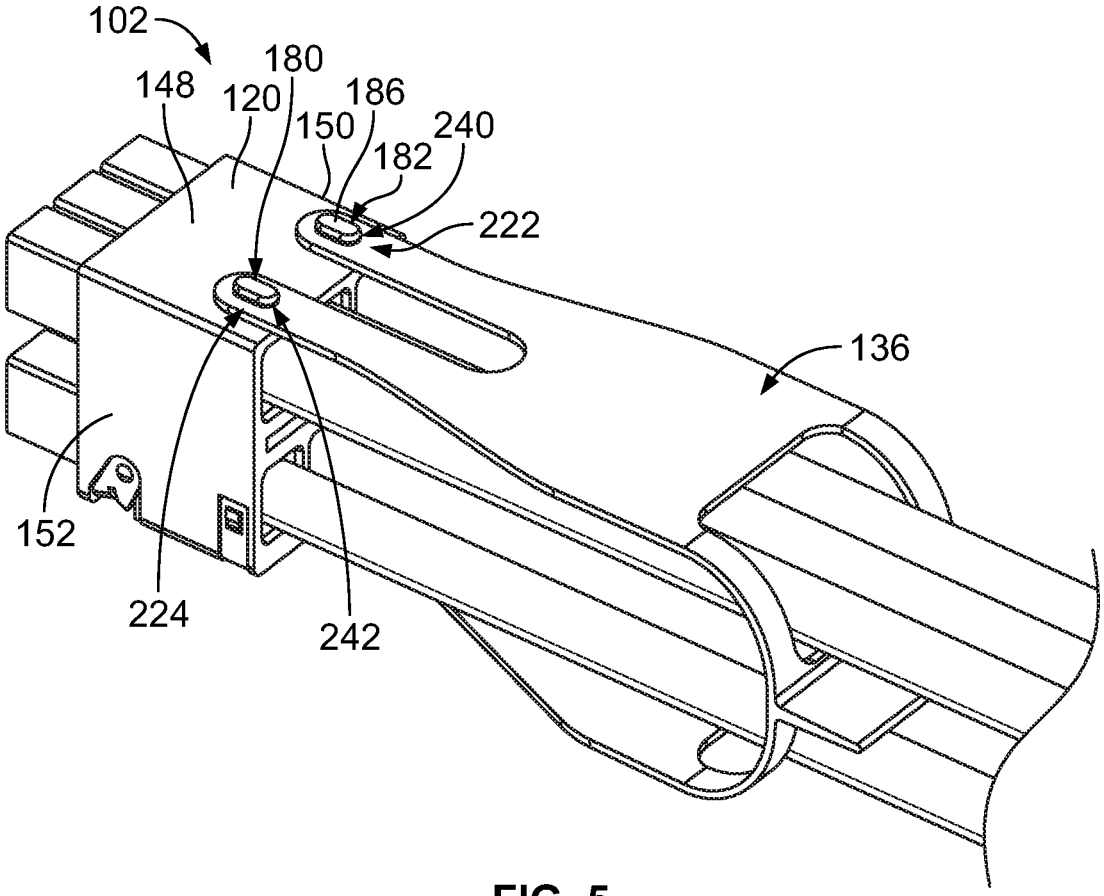
FIG. 5 is a bottom perspective view of the plug connector in accordance with an exemplary embodiment showing the pull tab coupled to the housing.

FIG. 4 is a bottom perspective view of the plug connector 102 in accordance with an exemplary embodiment. FIG. 5 is a bottom perspective view of the plug connector 102 in accordance with an exemplary embodiment showing the pull tab 136 coupled to the housing 120. In an exemplary embodiment, the housing 120 includes attachment members 180 extending from the second end 148 (for example, a bottom) of the housing 120. The first and second lower attachment members 222, 224 are secured to the attachment members 180. The first and second lower attachment members 222, 224 are attached to the housing 120 proximate to the first side 150 and the second side 152, respectively.

In various embodiments, the attachment members 180 may be cleats 182 having a neck 184 and an enlarged head 186. The openings 240, 242 receive the cleat 182 and is secured to the attachment member 180 by the enlarged head 186. Other types of attachment members may be used in alternative embodiments to secure the pull tab 136 to the housing 120.

Figure 6:
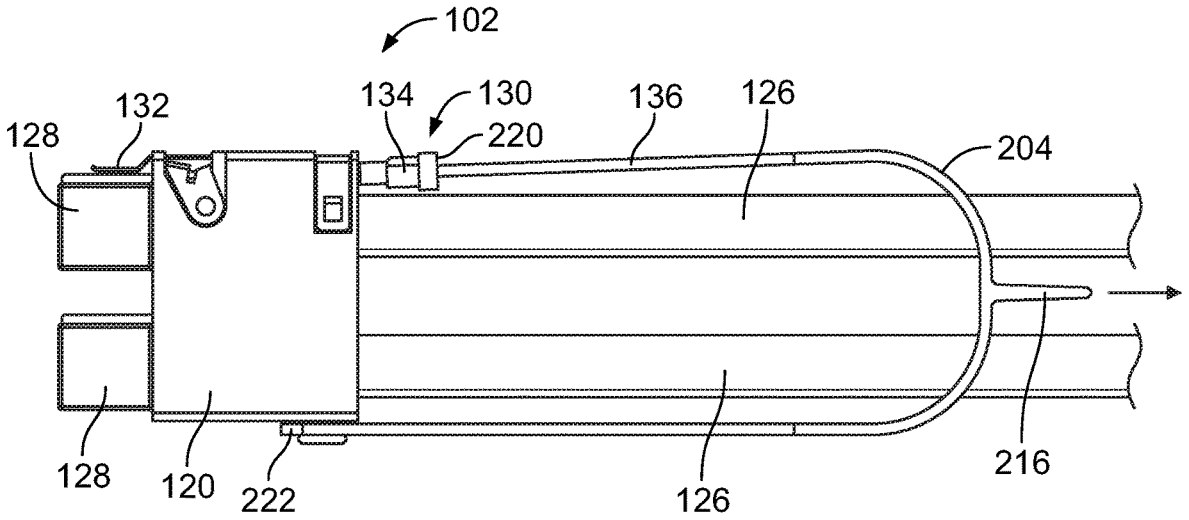
FIG. 6 is a side view of the plug connector illustrating a latch assembly in a latched position.
Figure 7:
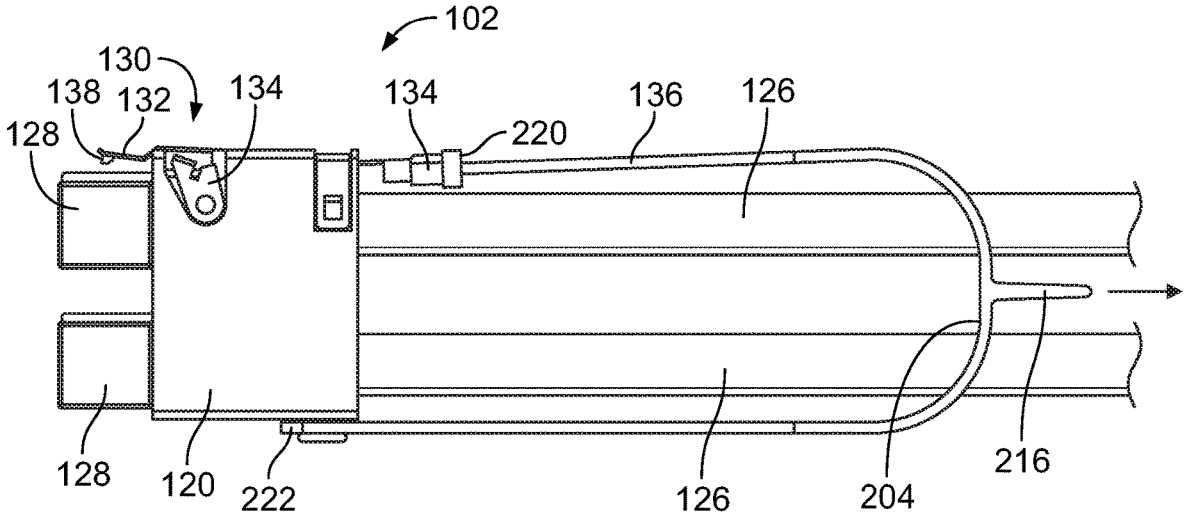
FIG. 7 is a side view of the plug connector illustrating the latch assembly in an unlatched position.

FIG. 6 is a side view of the plug connector 102 illustrating the latch assembly 130 in the latched position. FIG. 7 is a side view of the plug connector 102 illustrating the latch assembly 130 in the unlatched position. The pull tab 136 is used to actuate the actuator 134 to release the latch 132. The actuator 134 is pulled rearward by the pull tab 136 to rotate the actuator 134. The actuator 134 is used to lift the latch 132 to unlatch the latch beams 138.

The upper attachment member 220 of the pull tab 136 is coupled to the actuator 134 proximate to the top of the plug connector 102. The lower attachment members 222, 224 of the pull tab 136 are coupled to the housing 120 at the bottom of the plug connector 102. As such, the pull tab 136 is coupled to the plug connector 102 at multiple, spaced apart locations to distribute the pulling forces from the pull tab 136 to the plug connector 102. The rearward pulling forces are distributed between the top and the bottom of the plug connector 102 by the attachment of the pull tab 136 at the top and the bottom of the plug connector 102. The rear loops 204 of the pull tab 136 provide finger grips for gripping the pull tab 136 and pulling the pull tab 136 rearward. The rear loops 204 may be engaged from both sides of the bundle of cables 126 (for example, using a finger and thumb to pull from both sides). As such, the gripping location may be approximately centered between the top and the bottom of the plug connector 102 to center the pulling force and ensure that the forces are distributed to the top and the bottom of the housing 120. As such, the upper shrouds 128 and the lower shrouds 128 may be pulled straight out of the receptacle connector 104 in the rearward unmating direction, rather than being pivoted or rotated (such as if the majority or all of the pulling force was distributed to the top or if the majority or all of the pulling force was distributed to the bottom), which could cause binding of the plug connector 102 with the receptacle connector 104. The strengthening member 216 may provide a finger grip for gripping the pull tab 136 and pulling the pull tab 136 rearward. The strengthening member 216 may be gripped and pulled from between the upper and lower rows of cables.

Figure 8:
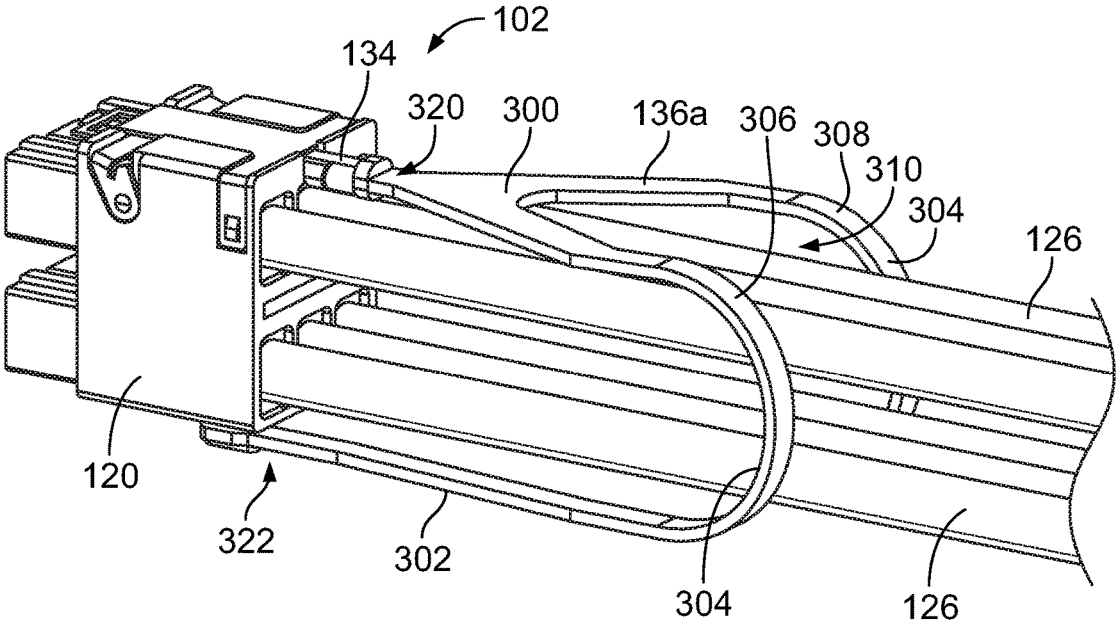
FIG. 8 is a rear perspective view of the plug connector with a pull tab in accordance with an exemplary embodiment.
Figure 9:
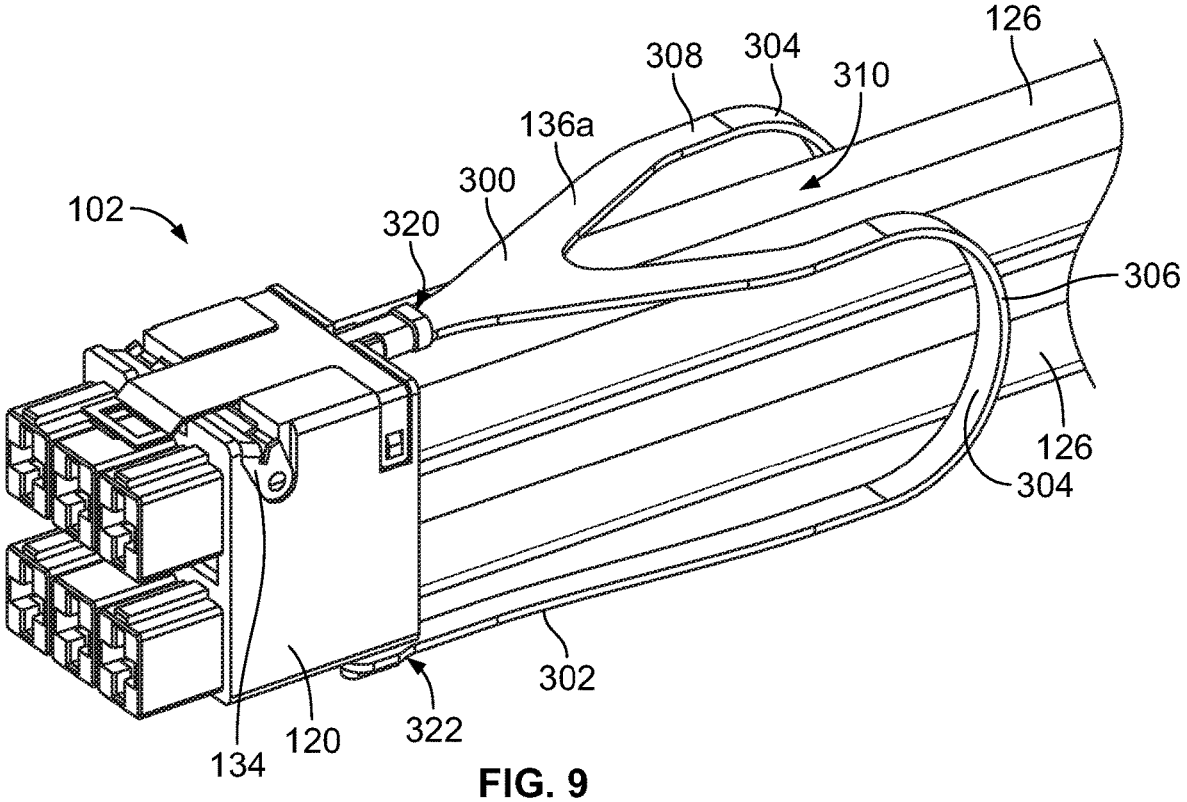
FIG. 9 is a front perspective view of the plug connector with the pull tab in accordance with an exemplary embodiment.

FIG. 8 is a rear perspective view of the plug connector 102 with a pull tab 136*a* in accordance with an exemplary embodiment. FIG. 9 is a front perspective view of the plug connector 102 with the pull tab 136*a* in accordance with an exemplary embodiment. The pull tab 136*a* is similar to the pull tab 136 shown in FIGS. 1 and 2; however the pull tab 136*a* is shaped differently than the pull tab 136.

The pull tab 136*a* includes an upper member 300 and a lower member 302. The pull tab 136*a* includes one or more rear loops 304 between the upper member 300 and the lower member 302. The rear loops 304 may provide a finger grip for pulling the pull tab 136*a* rearward. The cables 126 (shown in FIG. 3) are configured to pass through the pull tab 136*a* between the upper member 300 and the lower member 302. The pull tab 136*a* includes a first side rail 306 at a first side of the pull tab 136*a* and a second side rail 308 at a second side of the pull tab 136*a*. The side rails 306, 308 are separated by a gap 310. The pull tab 136*a* does not include the tie beams 212 or the strengthening member 216 (both shown in FIG. 2).

The pull tab 136*a* includes an upper attachment member 320, a first lower attachment member 322 and a second lower attachment member (not shown). The attachment members 320, 322 may be similar to the attachment members 220, 222, 224 (shown in FIG. 2). The upper attachment member 320 is coupled to the actuator 134 to pull the actuator 134 rearward. The upper attachment member 320 is configured to pull the housing 120 in an unmating direction to unmate the housing 120 from the receptacle connector 104 (shown in FIG. 1). The lower attachment members 322 are configured to be coupled to the bottom of the housing 120. The lower attachment members 322 are configured to pull the housing 120 in an unmating direction to unmate the housing 120 from the receptacle connector 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A plug connector comprising:

a housing having a front and a rear, the housing having a first end and a second end opposite the first end extending between the front and the rear, the housing having a first side and a second side opposite the first side extending between the front and the rear, the housing having a mating end at the front for mating with a mating connector, the housing having a latch pocket at the first end;

plug connector contacts held by the housing, the plug connector contacts provided proximate to the mating end for mating with the mating connector; and a latch assembly coupled to the housing for latchably securing the plug connector to the mating connector, the latch assembly comprising:

a latch received in the latch pocket, the latch having a main body and a latch beam extending from the main body, the latch beam movable between a latched position and an unlatched position, the latch beam configured to be received in a latch opening of the mating connector to secure the plug connector to the mating connector in the latched position, the latch beam being removable from the latch opening in the unlatched position;

an actuator operably coupled to the latch to move the latch to a released position, the actuator engaging the main body of the latch for actuation of the latch; and a pull tab extending from the rear of the housing, the pull tab having a first attachment member coupled to the actuator proximate to the first end of the housing, the first attachment member being movable in a rearward pulling direction to move the actuator and actuate the latch to the unlatched position, the first attachment member pulling the first end of the housing to unmate the housing from the mating connector with the latch in the unlatched position, the pull tab having a second attachment member coupled to the second end of the housing, the second attachment member pulling the second end of the housing to unmate the housing from the mating connector with the latch in the unlatched position.

2. The plug connector of claim 1, wherein the pull tab distributes pulling forces between the first and second attachment members to pull the first end and the second end of the housing for unmating the housing from the mating connector.

3. The plug connector of claim 1, wherein the pull tab includes a rear loop between the first and second attachment members, the rear loop being pulled rearward to move the first and second attachment members rearward.

4. The plug connector of claim 1, wherein the first attachment member is a movable attachment member movable relative to the housing, the second attachment member being a fixed attachment member fixed relative to the housing.

5. The plug connector of claim 1, wherein the pull tab includes a first side rail at a first side of the pull tab extending between the first and second attachment members and the pull tab includes a second side rail at a second side of the pull tab extending between the first and second attachment members, the pull tab including a gap between the first and second side rails, the gap receiving cables extending rearward of the housing, the cables terminated to corresponding plug connector contacts.

6. The plug connector of claim 5, wherein the pull tab includes a tie beam between the first and second side rails to hold the relative positions of the first and second side rails across the gap.

7. The plug connector of claim 5, wherein the pull tab includes a window at a rear of the pull tab between the first and second side rails, the cables extending from the gap through the window.

8. The plug connector of claim 7, wherein the pull tab includes a strengthening member spanning across the window between the first and second side rails, the strengthening member passing between an upper row of the cables and a lower row of the cables.

9. The plug connector of claim 5, wherein the pull tab includes a finger ring between the first and second side rails at a rear of the pull tab, the finger ring being pulled rearward to move the pull tab in the rearward direction.

10. The plug connector of claim 1, wherein the pull tab includes a third attachment member coupled to the second end of the housing, the second attachment member being coupled to the housing proximate to the second side of the housing.

11. The plug connector of claim 1, wherein the actuator includes connecting beam coupled to the first attachment member and an actuating beam extending from the connecting beam, the actuating beam engaging the latch to move the latch to the unlatched position.

12. The plug connector of claim 11, wherein the actuator includes a mounting tab pivotably coupled to the housing.

13. A plug connector comprising:

a housing having a front and a rear, the housing having a first end at a top of the plug connector and a second end at a bottom of the plug connector, the housing having a first side and a second side opposite the first side extending between the front and the rear, the housing having a mating end at the front for mating with a mating connector, the housing having a latch pocket at the first end, the housing having contact channels extending between the front and the rear, the contact channels being arranged in an upper row proximate to the first end and a lower row proximate to the second end;

plug connector contacts held by the housing, the plug connector contacts being received in corresponding contact channels and arranged in the upper row and the lower row, the plug connector contacts provided proximate to the mating end for mating with the mating connector, the plug connector contacts being terminated to ends of cables, the cables extending from the rear; and a latch assembly coupled to the housing for latchably securing the plug connector to the mating connector, the latch assembly comprising:

a latch received in the latch pocket, the latch having a main body and a latch beam extending from the main body, the latch beam movable between a latched position and an unlatched position, the latch beam configured to be received in a latch opening of the mating connector to secure the plug connector to the mating connector in the latched position, the latch beam being removable from the latch opening in the unlatched position;

an actuator operably coupled to the latch to move the latch to a released position, the actuator engaging the main body of the latch for actuation of the latch; and a pull tab extending from the rear of the housing, the pull tab having an upper attachment member coupled to the actuator proximate to the first end of the housing, the upper attachment member being movable in a rearward pulling direction to move the actuator and actuate the latch to the unlatched position, the upper attachment member pulling the first end of the housing above the upper row to unmate the housing from the mating connector with the latch in the unlatched position, the pull tab having a lower attachment member coupled to the second end of the housing, the lower attachment member pulling the second end of the housing below the lower row to unmate the housing from the mating connector with the latch in the unlatched position.

14. The plug connector of claim 13, wherein the pull tab distributes pulling forces between the upper attachment member and the lower attachment member to pull the first end and the second end of the housing for unmating the housing from the mating connector.

15. The plug connector of claim 13, wherein the pull tab includes a rear loop between the upper attachment member and the lower attachment member, the rear loop being pulled rearward to move the upper and lower attachment members rearward.

16. The plug connector of claim 13, wherein the upper attachment member is a movable attachment member movable relative to the housing and wherein the lower attachment member is a fixed attachment member fixed relative to the housing.

17. The plug connector of claim 13, wherein the pull tab includes a first side rail at a first side of the pull tab extending between the upper and lower attachment members and the pull tab includes a second side rail at a second side of the pull tab extending between the upper and lower attachment members, the pull tab including a gap between the first and second side rails, the gap receiving the cables rearward of the housing.

18. The plug connector of claim 17, wherein the pull tab includes a tie beam between the first and second side rails to hold the relative positions of the first and second side rails across the gap.

19. The plug connector of claim 13, wherein the lower attachment member is coupled to the housing proximate to the first side of the housing, the pull tab including a second lower attachment member coupled to the second end of the housing proximate to the second side of the housing.

20. A plug connector comprising:

a housing having a front and a rear, the housing having a first end at a top of the plug connector and a second end at a bottom of the plug connector, the housing having a first side and a second side opposite the first side extending between the front and the rear, the housing having a mating end at the front for mating with a mating connector, the housing having a latch pocket at the first end, the housing having contact channels extending between the front and the rear;

plug connector contacts held by the housing, the plug connector contacts being received in corresponding contact channels, the plug connector contacts provided proximate to the mating end for mating with the mating connector, the plug connector contacts being terminated to ends of cables, the cables extending from the rear; and a latch assembly coupled to the housing for latchably securing the plug connector to the mating connector, the latch assembly comprising:

a latch received in the latch pocket, the latch having a main body and a latch beam extending from the main body, the latch beam movable between a latched position and an unlatched position, the latch beam configured to be received in a latch opening of the mating connector to secure the plug connector to the mating connector in the latched position, the latch beam being removable from the latch opening in the unlatched position;

an actuator operably coupled to the latch to move the latch to a released position, the actuator engaging the main body of the latch for actuation of the latch; and a pull tab extending from the rear of the housing, the pull tab having an upper attachment member coupled to the actuator proximate to the first end of the housing, the pull tab having a lower attachment member coupled to the second end of the housing, the pull tab having a side rail extending between the upper attachment member and the lower attachment member, the side rail extending along a side of the cables, the side rail being pulled to pull the upper attachment member in a rearward pulling direction to move the actuator and actuate the latch to the unlatched position, the upper attachment member and the lower attachment member pulling the housing rearward to unmate the housing from the mating connector with the latch in the unlatched position.

* * * * *